US006994400B2

(12) United States Patent
Koepke et al.

(10) Patent No.: US 6,994,400 B2
(45) Date of Patent: Feb. 7, 2006

(54) CHAIR WITH ADJUSTABLE SEAT DEPTH

(75) Inventors: Marcus C. Koepke, Indianapolis, IN (US); Jesse J. Hahn, Cedar Rapids, IA (US); Jay R. Machael, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 10/748,079

(22) Filed: Dec. 30, 2003

(65) Prior Publication Data

US 2005/0140195 A1 Jun. 30, 2005

(51) Int. Cl.
*A47C 1/023* (2006.01)

(52) U.S. Cl. ..... 297/337; 297/344.1

(58) Field of Classification Search ..... 297/344.1, 297/337, 317, 341, 344.13, 344.14, 329
See application file for complete search history.

(56) References Cited

U.S. PATENT DOCUMENTS 1,191,269 A * 7/1916 Balser ..... 297/344.14
2,141,262 A * 12/1938 Cole ..... 297/294
3,390,857 A 7/1968 Nystrom
5,035,466 A * 7/1991 Mathews et al. ..... 297/337
5,596,910 A * 1/1997 Bauer et al. ..... 74/526
6,027,168 A * 2/2000 Crossman et al. ..... 297/337
6,135,556 A * 10/2000 Chu et al. ..... 297/337
6,273,506 B1 8/2001 Niergarth et al.
6,293,622 B1 * 9/2001 Horisawa ..... 297/344.1
6,634,711 B2 * 10/2003 Phillips et al. ..... 297/337
6,767,062 B2 * 7/2004 Piretti ..... 297/337
2002/0074841 A1 * 6/2002 Chen ..... 297/337
2003/0234566 A1 * 12/2003 Vanderminden et al. . 297/258.1

* cited by examiner

*Primary Examiner*—Peter M. Cuomo
*Assistant Examiner*—Stephen D'Adamo
(74) *Attorney, Agent, or Firm*—Joseph H. Golant; Jones Day

(57) ABSTRACT

A chair has a seat that can be longitudinally repositioned by the user while the user is seated on the chair, so as to accommodate users of different heights and physical dimensions. The chair includes a base, a seat slidable mounted on a seat plate, and activating arm that operates on lock means that engage the seat plate to secure the seat in a preferred longitudinal position relative to the seat plate.

11 Claims, 6 Drawing Sheets

CHAIR WITH ADJUSTABLE SEAT DEPTH

CROSS-REFERENCE TO RELATED APPLICATIONS

This patent application is related to the patent applications "Chair with Backward and Forward Passive Tilt," application Ser. No. 10/749,008; "Horizontally Adjustable Arm Rest," application Ser. No. 10/748,537; "Chair Back Rest with Improved Resilience and Support," application Ser. No. 10/750,576; "Vertically Adjustable Arm Rest," application Ser. No. 10/749,010; and "Chair with Tilt Lock Mechanism," application Ser. No. 10/749,009; each application being filed on even date herewith and incorporated herein by reference in its entirety.

BACKGROUND OF THE INVENTION

This invention relates to an office chair in which the position of the seat is adjustable relative to the back of the chair in the forward and backward directions to accommodate users of different heights. More particularly, this invention relates to an office chair in which the position of the seat is adjustable relative to the back of the chair in the forward and backward direction, and in which the mechanism for such forward and backward adjustment does not add to the height of the seat relative to the floor.

Office chairs generally comprise a base, a seat, and a backrest. Such office chairs are mass-produced, yet must be comfortable for users of all heights and weights. This can be a challenge, because the sizes of each of the components of such office chairs are necessarily fixed. One approach to this problem has been to provide backrests that are adjustable in the vertical direction, so that they can be adjusted upwardly to accommodate taller users, and downwardly to accommodate shorter users. In this way, each user can adjust the chair backrest to obtain optimum lumbar support. Another important parameter in determining office chair comfort is adequate thigh support, as determined by the depth of the seat portion. A seat with a longer depth will provide good thigh support for a taller, longer-legged user. For a shorter user, however, the longer seat depth will maintain the user's back too far away from the backrest, so that the shorter user will slump backward when his/her back rests against the backrest. A seat with a depth of proper longitudinal dimension for a shorter user will allow the shorter user's back to engage the backrest when the user is in a proper erect posture with the feet place flat on the floor. For a taller user, however, such a seat will provide inadequate support of the user's legs, resulting in fatigue and discomfort.

It is thus one object of the invention to provide a chair in which the position of the seat is adjustable in the longitudinal direction, i.e., forwardly and rearwardly, according to the needs of the user.

It is another object of the invention to provide a chair in which the position of the seat is adjustable in the longitudinal direction by the user while the user is seated in the chair.

It is another object of the invention to provide a chair in which the position of the seat is adjustable in the longitudinal direction by the user and in which the adjustment mechanism does not add significantly to the height of the seat above the floor.

SUMMARY OF THE INVENTION

In one aspect of the invention, a chair comprises a base; a seat plate supported above the base; a seat pan slidably mounted to the seat plate so as to be slidable in the longitudinal direction; and longitudinally operating means for sliding the seat pan in a longitudinal direction with respect to said seat plate. The longitudinally operating means is movable by the user in a longitudinal direction to operate the sliding motion of the seat pan with respect to the seat plate.

In another aspect of the invention, the chair comprises means for locking the seat pan in a fixed longitudinally position relative to said seat plate. When a user engages the longitudinally operating means the locking means disengages to allow the seat pan to slide freely in the longitudinal direction with respect to the seat plate. When a user disengages the longitudinally operating means, the locking means engages to prevent sliding movement of the seat pan with respect to the seat plate.

In a preferred embodiment, an office chair comprises a base, a seat plate mounted to said base, a seat pan slidably mounted to said seat plate, such that said seat pan can slide in backward and forward directions relative to said seat plate, and a locking means for securing said seat pan to said seat plate at a location selected by a user. The operating means comprises an activating arm that slides within a longitudinal guide channel formed into the seat pan. The locking means comprises one or more lock pins disposed within the channel and which extend through holes in the channel to engage any of a plurality of notches on the stationary seat plate. Operation of the activating arm causes the lock pins to retract from the seat plate notches, so that the seat pan can slide forward or backward on the seat plate as the user desires. When the activating arm is released, the lock pins again extend outwardly through holes in the guide channel, to engage different notches in the seat plate, thereby fixing the seat pan at a desired position with respect to the seat plate.

The seat depth adjustment of the present invention is a simple, low-cost mechanism that is easy to operate with one hand. It also has a low vertical profile, so that it does not significantly add to the height of the seat pan relative to the floor on which the chair rests. The seat depth adjustment is built integrally into the chair, and does not need to be installed as an optional add-on, with the extra expense in labor and materials that such an add-on would entail. The seat depth adjustment makes the office chair more comfortable for users of different heights and proportions.

DESCRIPTION OF THE FIGURES

The present invention is more readily understood by the accompanying drawings of a preferred embodiment, wherein.

DETAILED DESCRIPTION OF A PREFERRED EMBODIMENT

Figure 1:
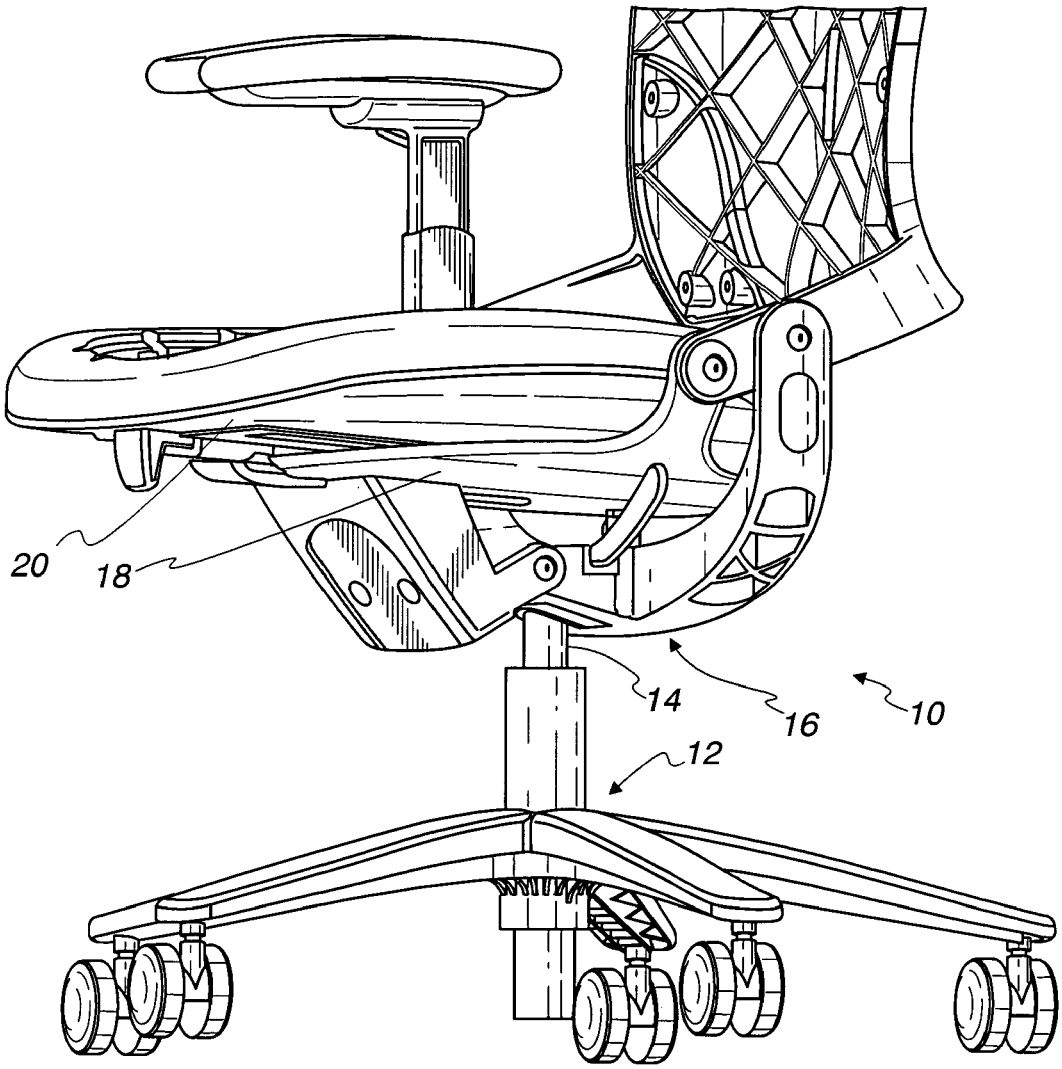
FIG. 1 is a bottom perspective view of an office chair having a seat depth adjustment mechanism of the present invention.

In accordance with the invention, a chair 10 such as an office chair comprises a base member 14 on a pedestal 12. Supported above the base 14 is a seat frame 16 that includes a seat plate 18. Slidably mounted on seat plate 18 is seat pan 20, which moves longitudinally, that is, in a forward and backward direction, with respect to seat plate 18. Seat plate 18 is longitudinally fixed with respect to base 14, although in some embodiments of an office chair having the seat depth mechanism of the invention, the seat plate can tilt forward or backward in response to the user's movement. Such optional forward and backward tilting is independent of the forward and backward sliding motion of the seat pan with respect to the seat plate, which is the subject of the present invention.

Figure 2:
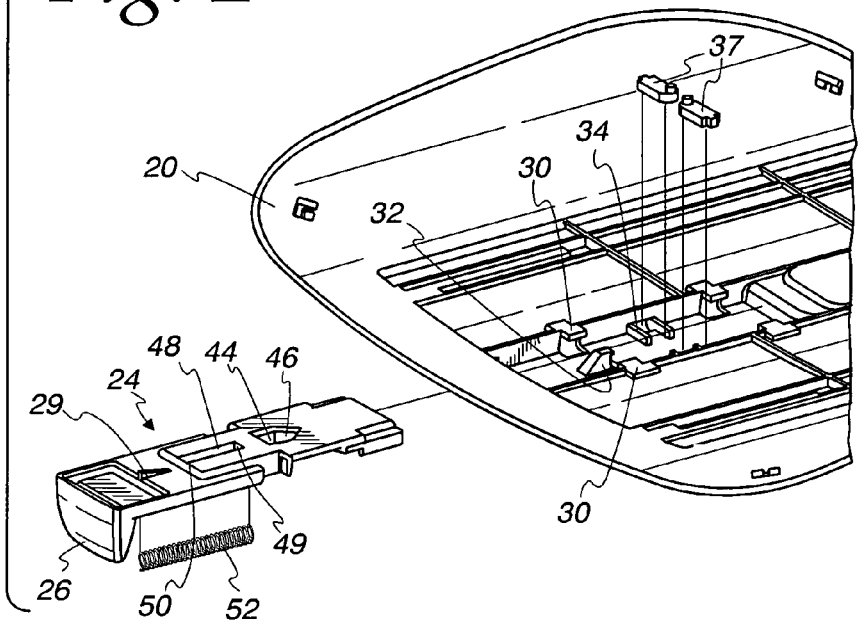
FIG. 2 is a top exploded view of a seat pan with seat depth adjustment activating arm.
Figure 3:
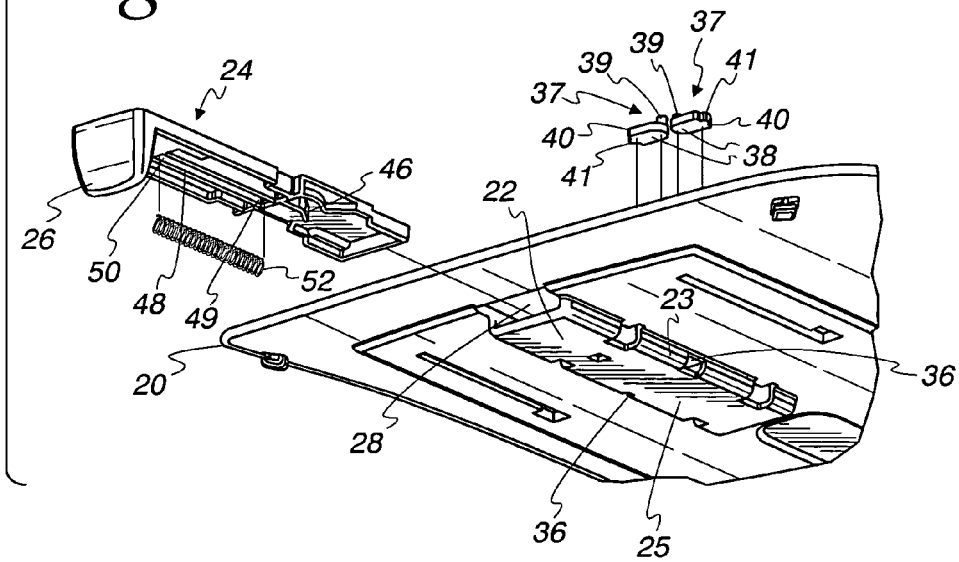
FIG. 3 is a bottom exploded view of a seat pan with seat depth adjustment activating arm.
Figure 4:
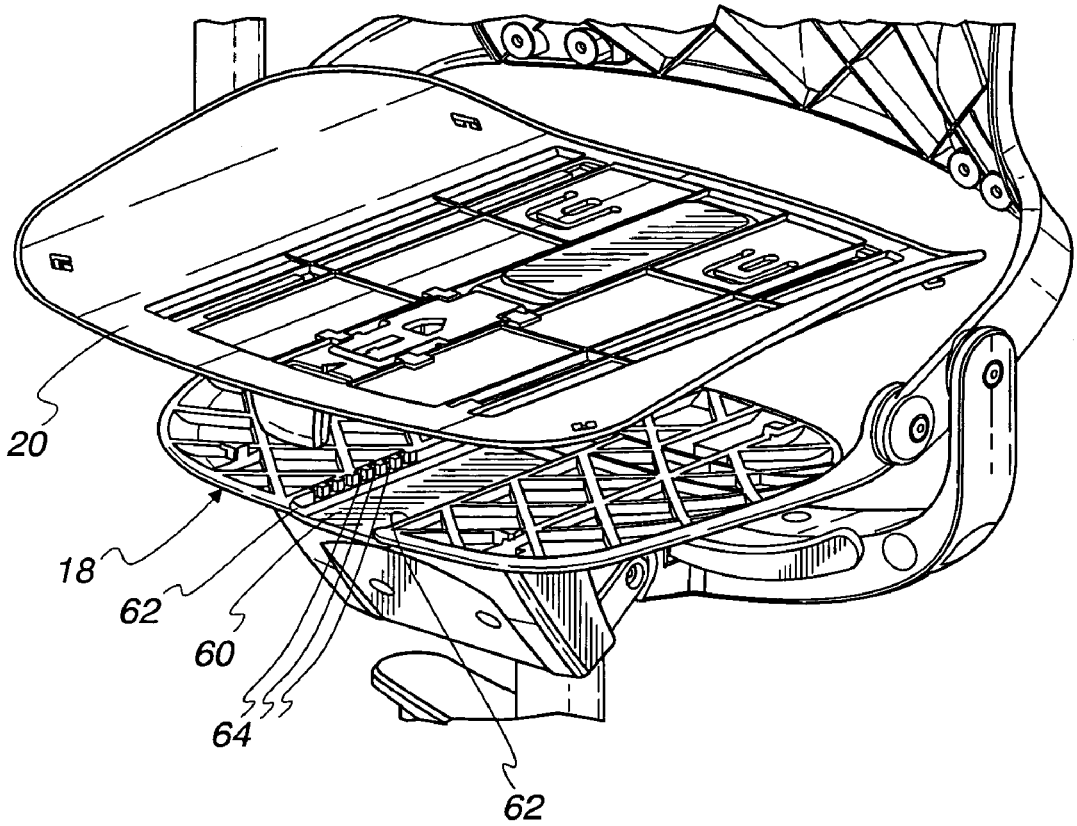
FIG. 4 is an exploded view of a seat pan and seat plate, with the activating arm installed over the locking pins.

As illustrated in FIGS. 2 and 3, the sliding motion of seat pan 20 with respect to seat plate 18 is controlled by a longitudinally operating means for sliding the seat pan 18 in a longitudinal direction, the operating means comprising activating arm 24. Seat pan 20 has formed therein means for receiving the activating arm comprising a longitudinal guide channel 22 that extends downwardly below the lower surface of seat pan 20. Slidably disposed within longitudinal guide channel 22 is activating arm 24. On the forward end of arm 24 is a handle 26. Handle 26 extends out of channel 22 near the forward edge of seat pan 20, and is constructed so as to be easily reached by a user sitting in the chair 10.

Figure 7:
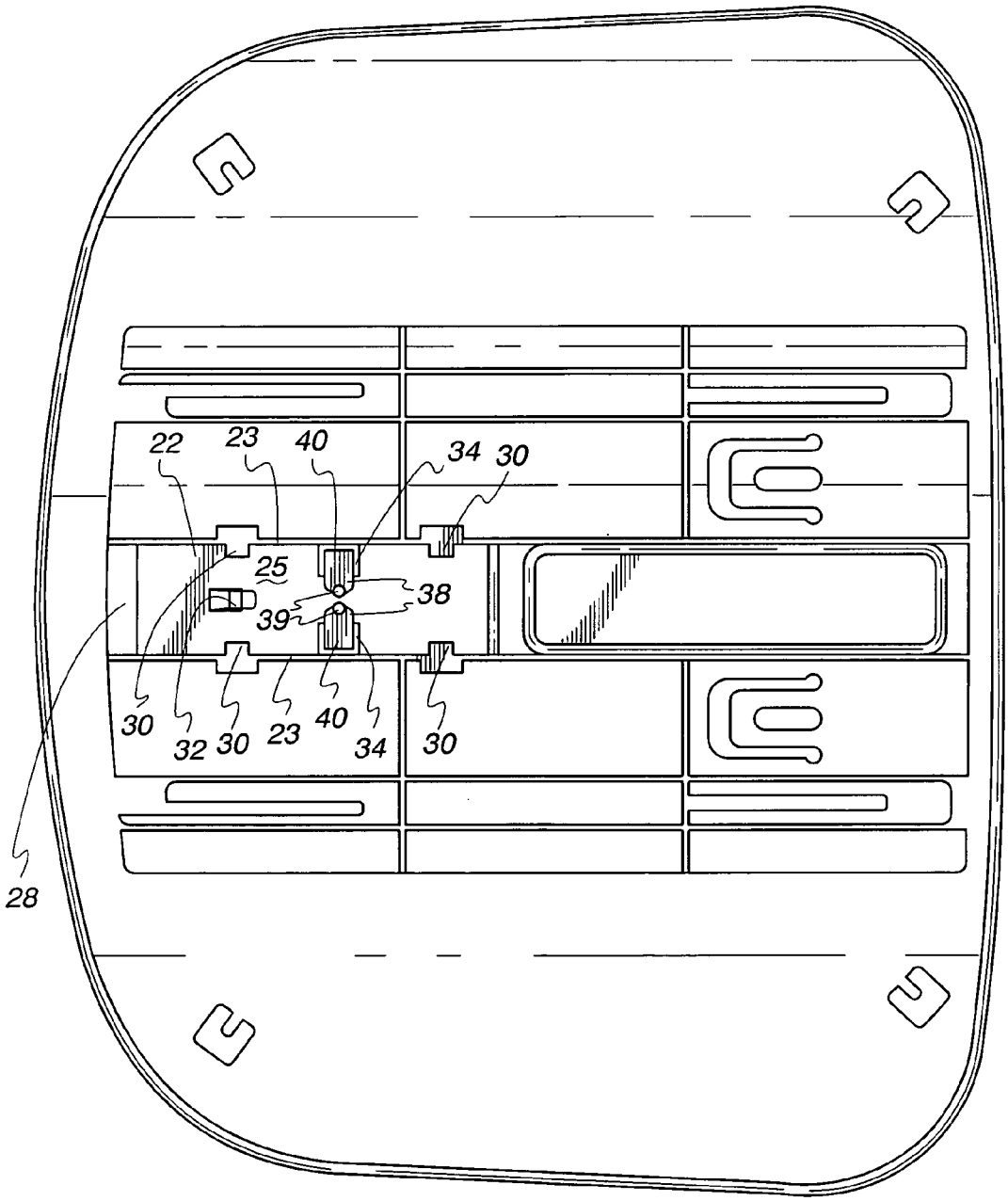
FIG. 7 is a top view of the seat pan with the locking pins, without the activating arm.

As seen in FIGS. 2 and 7, longitudinal guide channel 22 includes two longitudinal side walls 23 and a bottom wall 25. Bottom wall 25 of longitudinal guide channel 22 includes a forward opening 28 through which activating arm 24 can slide. Disposed on the inner surfaces of each longitudinal side wall 23 are two inwardly extending guide tabs 30 to guide the sliding movement of activating arm 24 within longitudinal guide channel 22. Bottom wall 25 supports on its upper surface an upwardly extending boss 32, and two transversely directed U-shaped locking pin frames 34. Between the arms of each U-shaped locking pin frame 34 is an aperture 36, formed in side wall 23 and bottom wall 25. Situated within each U-shaped locking pin frame 34 is a locking pin 37. Each locking pin 37 has an inner end 38 with a boss 39 extending upwardly therefrom, and an outer end 40 with a detent 41 extending transversely outward therefrom, detent 41 being sized and dimensioned to be able to extend through aperture 36.

Activating arm 24 is sized and dimensioned to slide longitudinally on bottom surface 25 and between longitudinal side walls 23 of longitudinal guide channel 22. The downward facing surface of activating arm 24 includes a downwardly extending depression 42 having a wider forward section 43 and a tapered rear section 45 that abuts the tapered inner ends 38 of locking pins 37. Extending outwardly from either side of wider forward section 43 are curved ridges 46 that extend rearwardly toward tapered rear section 45 to define two boss guide paths 47, each guide path 47 sized so as to accommodate a boss 39 on a locking pin 37. Activating arm 24 also includes longitudinal slot 48 with rearward end 49 and forward end 50. Longitudinal slot 48 is sized and dimensioned to fit over upwardly extending boss 32 on bottom wall 25 of longitudinal guide channel 22. A coil spring 52 rests on channel bottom surface 25, seated within longitudinal slot 48 between upwardly extending boss 32 and longitudinal slot rear surface 49.

Seat plate 18 includes a longitudinal receiving channel 60 having two longitudinal side walls 62. Longitudinal receiving channel 60 is sized and dimensioned to receive downwardly extending longitudinal guide channel 22. Each longitudinal side wall 62 is provided with a plurality of notches 64, capable of receiving detent 41 on the outer end 40 of locking pin 37.

Figure 5:
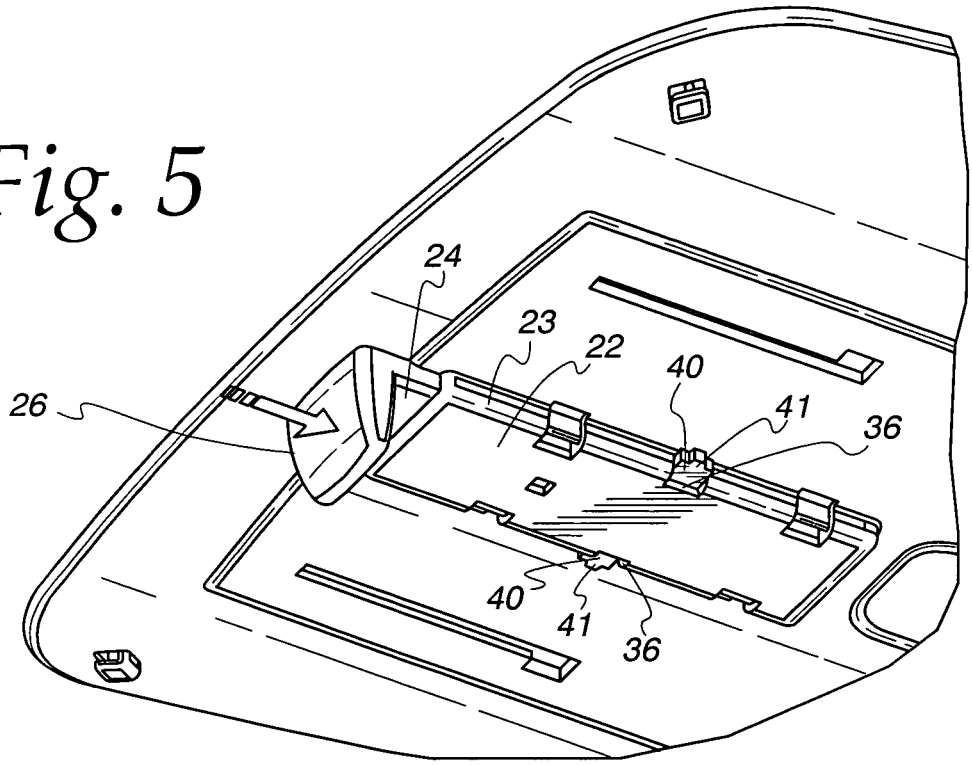
FIG. 5 is a bottom view of a seat pan with the seat depth adjustment activating arm in a retracted locked position.
Figure 6:
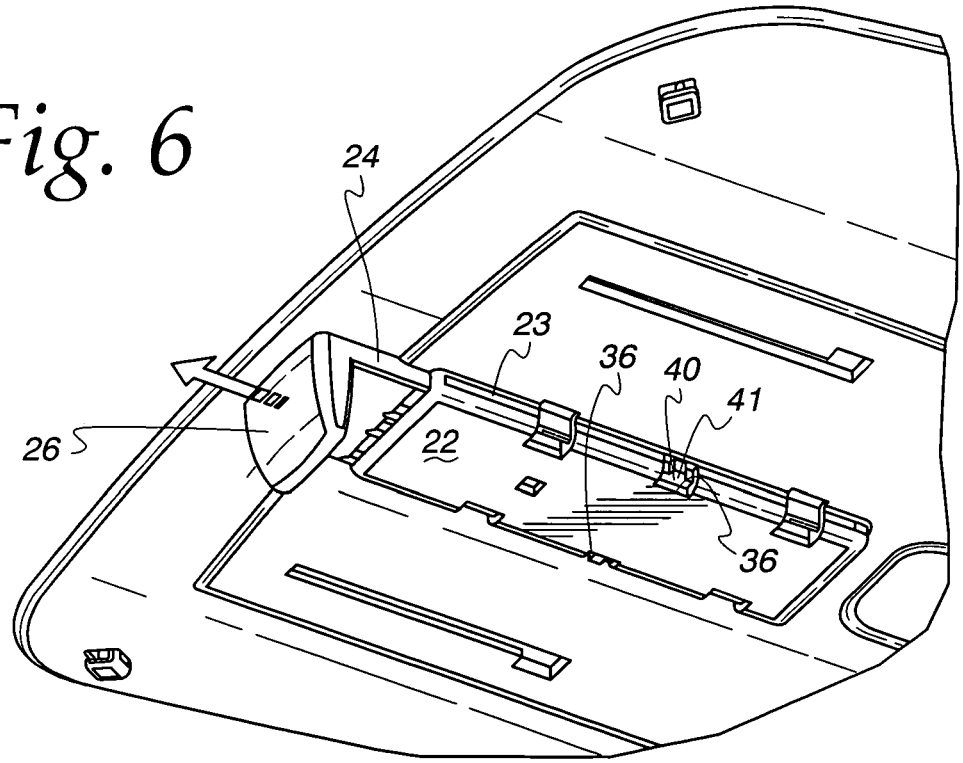
FIG. 6 is a bottom view of a seat pan with the seat depth adjustment activating arm in an extended unlocked position.
Figure 8:
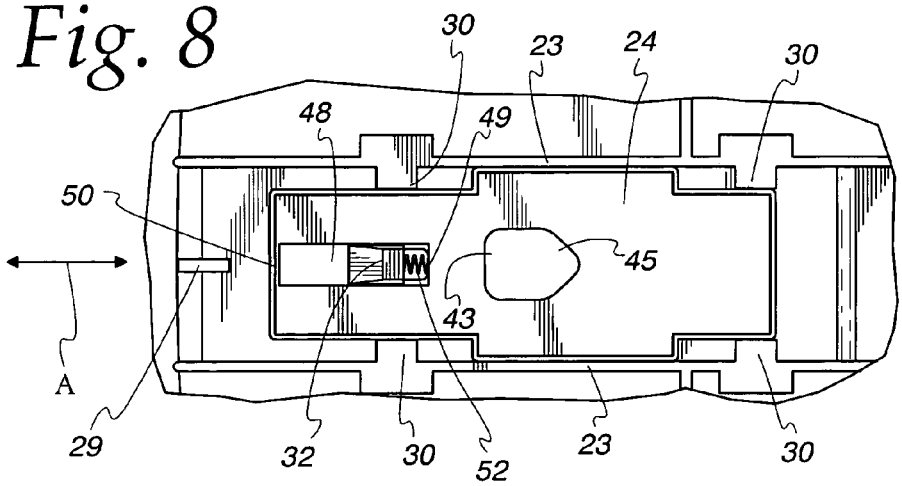
FIG. 8 is a top view of the seat pan with seat depth adjustment activating arm installed over the locking pins.
Figure 9:
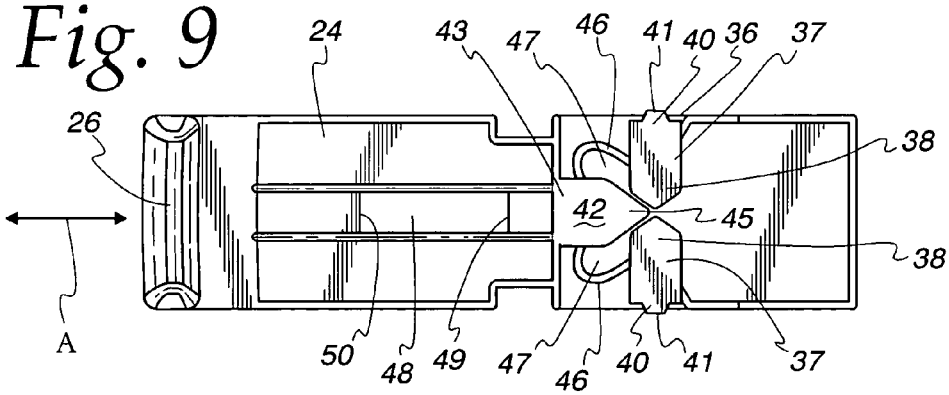
FIG. 9 is a bottom view of the seat depth adjustment activating arm operating on the locking pins.

When the seat depth adjustment mechanism of the present invention is in its passive state as shown in FIG. 5, spring 52 is extended, with one end pushing forwardly against upwardly extending boss 32 and the other end pushing rearwardly against rearward end 49 of longitudinal slot 48 in activating arm 24, thus urging activating arm 24 in a rearward direction. Tapered rear section 45 of downwardly extending depression 42 is forced between the inner ends 38 of locking pins 37, pushing them apart in the transverse direction. The locking pin bosses 39 are guided along the boss guide paths 47 such that the locking pins 37 are pushed outwardly until detents 41 on the outer ends 40 extend through apertures 36 in longitudinal guide channel 22. Each detent 41 will engage a notch 64 in side wall 62 of longitudinal receiving channel 60 of seat plate 18. A user can activate the seat depth adjustment mechanism by pulling forwardly on handle 26 of activating arm 24 in the direction indicated by the arrow "A" in FIGS. 8, 9. An upwardly extending projection 29 on the top surface of activating arm 24 will engage the forward edge of opening 28 to prevent over-extension of arm 24. As the activating arm 24 moves forward, rearward end 49 of longitudinal slot 48 will move forwardly to compress coil spring 52 against upwardly extending boss 32. Also, downwardly extending depression 42 and curved ridges 46 will move forwardly. As shown in FIG. 9, bosses 39 of locking pins 37 will be pulled inwardly along boss guide paths 47, causing locking pins 37 to retract into longitudinal guide channel 22. Then detents 41 no longer extend through apertures 36, and no longer engage notches 64 on side walls 62 of seat plate longitudinal receiving channel 60. The user is then free to slide the seat pan 20 forwardly and rearwardly with respect to seat plate 18. When the user achieves a seat depth that is comfortable, the user releases handle 26. Coil spring 52 extends, urging activating arm 24 rearwardly. Tapered end 45 of downwardly extending depression 42 is urged between the inner ends 38 of locking pins 37. The locking pin bosses 39 are urged along boss guide paths 47 until detents 41 of locking pins 37 are pushed out of apertures 36 and engage different notches 64 on side walls 62 of seat plate longitudinal receiving channel 60, thus locking the seat pan at the desired depth relative to the seat plate.

There has been disclosed a mechanism for adjusting the depth of a seat of an office chair to accommodate users of different heights and physical dimensions. The mechanism is easily used by a person while seated in the chair, without the use of tools. Although the present invention has been described with reference to preferred embodiments, those skilled in the art will recognize that changes may be made by the use of known equivalents without departing from the spirit and scope of the invention. The foregoing description of a preferred embodiment is to be regarded as illustrative of rather than limiting the scope of the invention, which is defined by the claims appended hereto.

What is claimed is:

1. A chair comprising:

a base;

a seat plate supported above said base;

a seat pan slidably mounted to said seat plate so as to be slidable in the longitudinal direction;

longitudinally operating means for sliding said seat pan in the longitudinal direction with respect to said seat plate, said seat pan comprising first receiving means for receiving said longitudinally operating means; and locking means for locking said seat pan in a fixed longitudinal position relative to said seat plate;

said locking means comprising transversely movable engaging means for engaging said seat plate, said transversely movable engaging means being movable by said longitudinally operating means, wherein said seat plate comprises a plurality of notches, said first receiving means of said seat pan comprising at least one aperture, said transversely movable engaging means being movable between an extended position extending through said at least one aperture to engage at least one of said plurality of notches, and a retracted position being retracted from said at least one aperture so as not to engage said at least one of said plurality of notches.

2. The chair of claim 1 wherein said longitudinally operating means comprises guide means for guiding the movement of said locking means.

3. The chair of claim 2 wherein said locking means comprises a boss received within said guide means such that said locking means moves in response to movement of said longitudinally operating means.

4. The chair of claim 3 further including biasing means for biasing said longitudinally operating means to move so that the locking means are in the extended position.

5. The chair of claim 4 wherein said biasing means operates on said longitudinally operating means.

6. The chair of claim 5 wherein said biasing means operates on said seat pan.

7. A chair comprising:

a base;

a seat plate supported above said base;

a seat pan slidably mounted to said seat plate so as to be slidable in the longitudinal direction;

longitudinally operating means for sliding said seat pan in the longitudinal direction with respect to said seat plate, said seat pan comprising first receiving means for receiving said longitudinally operating means; and locking means for locking said seat pan in a fixed longitudinal position relative to said seat plate;

said locking means comprising transversely movable engaging means for engaging said seat plate;

said transversely movable engaging means being moved by said longitudinally operating means, wherein said seat plate comprises a plurality of notches, said first receiving means of said seat pan comprising at least one aperture, said transversely movable engaging means being movable between an extended position extending through said at least one aperture to engage at least one of said plurality of notches, and a retracted position being retracted from said at least one aperture so as not to engage said at least one of said plurality of notches, said longitudinally operating means comprising guide means for guiding the movement of said locking means, said locking means comprising a boss received within said guide means such that said locking means moves in response to movement of said longitudinally operating means, said chair further including biasing means for biasing said longitudinally operating means to move so that the locking means are in the extended position, wherein said biasing means operates on said longitudinally operating means and on said seat pan, said locking means operating in cooperation with said longitudinally operating means.

8. The chair of claim 7 wherein said transversely movable engaging means comprises at least one transversely movable locking pin for engaging said seat plate.

9. The chair of claim 7 wherein said biasing means is a spring having first and second opposed ends.

10. The chair of claim 9 wherein said first end of said spring urges against said longitudinal operating means.

11. The chair of claim 10 wherein said second end of said spring urges against said seat pan.

* * * * *